US007439868B2

(12) United States Patent
Zhang

(10) Patent No.: US 7,439,868 B2
(45) Date of Patent: Oct. 21, 2008

(54) DRIVE CIRCUIT FOR DRIVING INDICATOR IN COMPUTER SYSTEM

(75) Inventor: Xiang Zhang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 78 days.

(21) Appl. No.: 11/308,936

(22) Filed: May 29, 2006

(65) Prior Publication Data

US 2007/0075872 A1 Apr. 5, 2007

(30) Foreign Application Priority Data

Sep. 30, 2005 (CN) ..... 200520065326

(51) Int. Cl.
*G08B 21/00* (2006.01)

(52) U.S. Cl. ..... 340/635; 340/815.4

(58) Field of Classification Search ..... 340/815.4, 340/635; 320/111, 23; 315/291
See application file for complete search history.

(56) References Cited

U.S. PATENT DOCUMENTS 5,481,177 A * 1/1996 Hamley ..... 320/111
6,094,029 A * 7/2000 Reynolds et al. ..... 320/111
6,559,606 B1 5/2003 Chou et al.
2002/0171467 A1* 11/2002 Worley et al. ..... 327/514
2003/0214242 A1* 11/2003 Berg-johansen ..... 315/169.3
2006/0232435 A1* 10/2006 Sotiriou ..... 340/815.4
2007/0008103 A1* 1/2007 Nicolls et al. ..... 340/515

* cited by examiner

*Primary Examiner*—George A Bugg
*Assistant Examiner*—Hoi C Lau
(74) *Attorney, Agent, or Firm*—Wei Te Chung

(57) ABSTRACT

A circuit for indicating status of a component of a computer system includes a first indicator (D1), a second indicator (D2), a power supply (V), a first transistor (Q1), and a second transistor (Q2). The first indicator includes a positive end and a negative end. The second indicator includes a positive end connected with the negative end of the first indicator, and a negative end connected with the positive end of the first indicator. The power supply is connected to the positive end of the first indicator via a first resistor, and connected to the positive end of the second indicator via a second resistor. The first transistor is connected between the negative end of the first indicator and a ground, and the second transistor is connected between the negative end of the second indicator and the ground.

9 Claims, 2 Drawing Sheets

DRIVE CIRCUIT FOR DRIVING INDICATOR IN COMPUTER SYSTEM

FIELD OF THE INVENTION

The present invention relates to a drive circuit, and particularly to a drive circuit which drives an indicator to indicate status of a component in a computer system.

DESCRIPTION OF RELATED ART

A computer system is composed of hardware and software. The hardware includes a motherboard, an optical disk drive, a hard disk drive, memory, a network card, and so on. When the computer system is running, it is necessary to know working statuses of the hardware. So indicator lights are used to show the working statues of the hardware, and corresponding drive circuits for driving these indicator lights are combined in the computer system.

A typical drive circuit includes a chip to drive an indicator. The chip uses a program to control the circuit. The indicator light is used to show a working status of a component. However, the drive circuit of the indicator must be controlled by the chip. It is unduly complex to use the chip because a controlling program is required. In addition, it is costly to use the chip to control the indicator. Furthermore, the chip is not suitable for controlling more than one indicator, which may be required in some computer systems.

What is needed is a simple drive circuit which can drive indicators to show working statuses of a component in a computer system.

SUMMARY OF THE INVENTION

A circuit for indicating status of a component of a computer system includes a first indicator, a second indicator, a power supply, a first transistor, and a second transistor. The first indicator includes a positive end and a negative end. The second indicator includes a positive end connected with the negative end of the first indicator, and a negative end connected with the positive end of the first indicator. The power supply is connected to the positive end of the first indicator via a first resistor, and connected to the positive end of the second indicator via a second resistor. The first transistor is connected between the negative end of the first indicator and a ground, and the second transistor is connected between the negative end of the second indicator and the ground.

Other advantages and novel features will be drawn from the following detailed description of a preferred embodiment with attached drawings, in which:

DETAILED DESCRIPTION OF THE INVENTION

Figure 1:
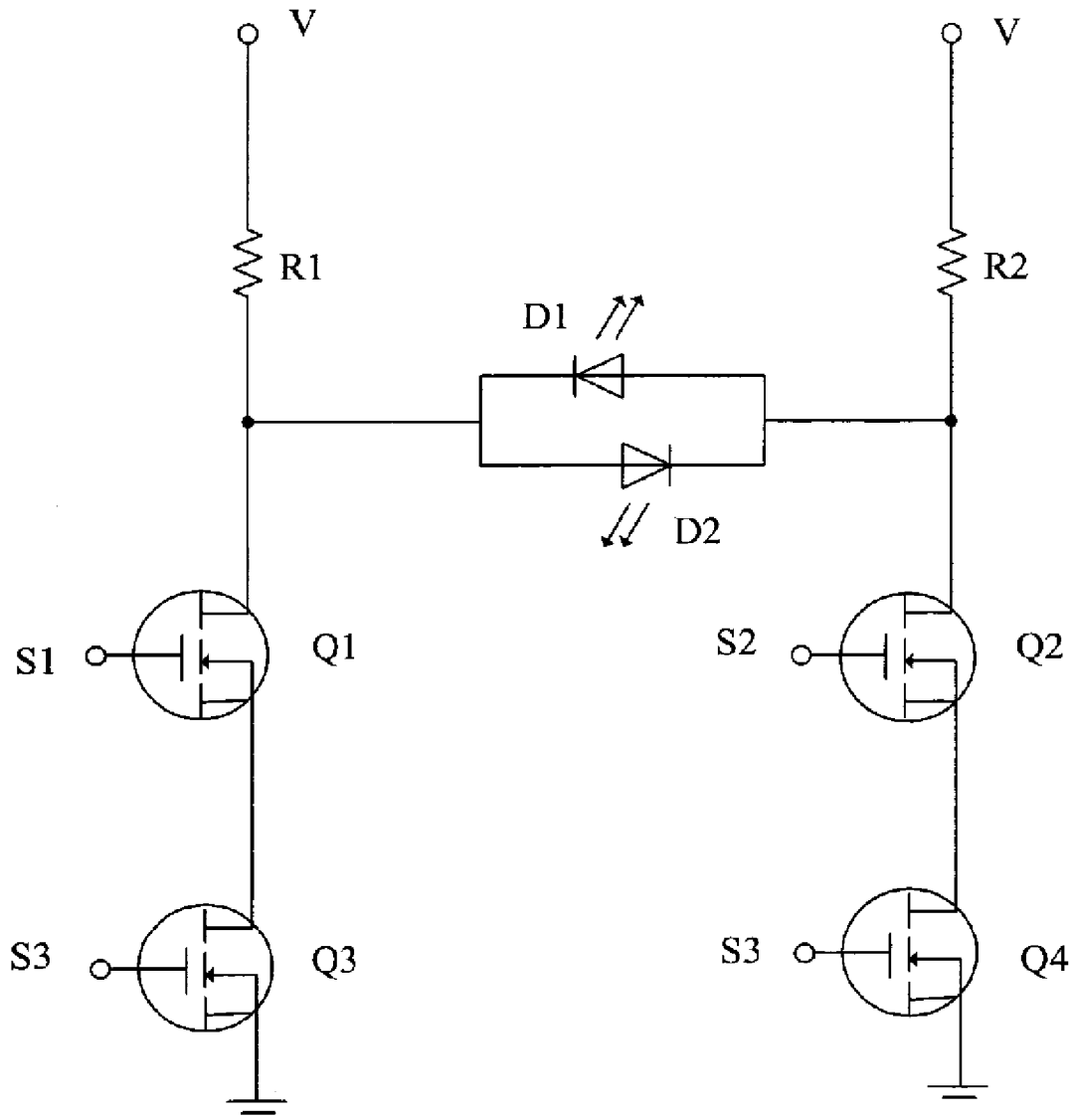
FIG. 1 is a diagram of a driving circuit for driving indicators in accordance with a preferred embodiment of the present invention.

Referring to FIG. 1, a circuit in accordance with a preferred embodiment of the present invention is shown for driving indicators which are used to indicate working statuses of a hard disk drive in a computer system. The circuit includes a power source V, a first resistor R1, a second resistor R2, a first light-emitting diode D1, a second light-emitting diode D2, a first, second, third, and fourth transistor Q1, Q2, Q3, and Q4, all of which are used as switch means in the circuit.

One end of the first resistor R1 is connected to the power supply V, defined as a first power source, and the other end is connected to a drain of the first transistor Q1. A first control signal S1 is transmitted to a gate of the first transistor Q1. When the hard disk drive is enabled to be operated, such as for reading or writing data, the control signal S1 is high. A source of the first transistor Q1 is connected to a drain of the third transistor Q3. A gate of the third transistor Q3 is connected to a third control signal S3. When a power source of the hard disk drive is normal, the third control signal S3 is high.

One end of the second transistor R2 is connected to the power supply V, defined as a second power source, and the other end is connected to a drain of the second transistor Q2. A second control signal S2 is transmitted to a gate of the second transistor Q2. When data is being written or read to or from the hard disk drive, the second control signal S2 is a square-wave signal. A source of the second transistor Q2 is connected to a drain of the fourth transistor Q4. A gate of the fourth transistor Q4 is connected to the third control signal S3. A source of the fourth transistor Q4 is connected to ground.

A positive terminal of the first light-emitting diode D1 is connected to the drain of the second transistor Q2, and a negative terminal is connected to the drain of the first transistor Q1. A positive terminal of the second light-emitting diode D2 is connected to the drain of the first transistor Q1, and a negative terminal is connected to the drain of the second transistor Q2.

When the hard disk drive is normal, each of the first control signal S1 and the third control signal S3 is high, thereby the first transistor Q1, the third transistor Q3, and the fourth transistor Q4 conduct. The power supply V lights the first light-emitting diode D1 via the second transistor R2, the first transistor Q1, and the third transistor Q3. The first light-emitting diode D1 lights to indicate that the hard disk drive is normal.

When data is written/read to/from the hard disk drive, the second signal S2 is a square-wave signal. The second transistor Q2 is switched between on and off, so the second light-emitting diode D2 flickers to indicate that the hard disk drive is active.

Figure 2:
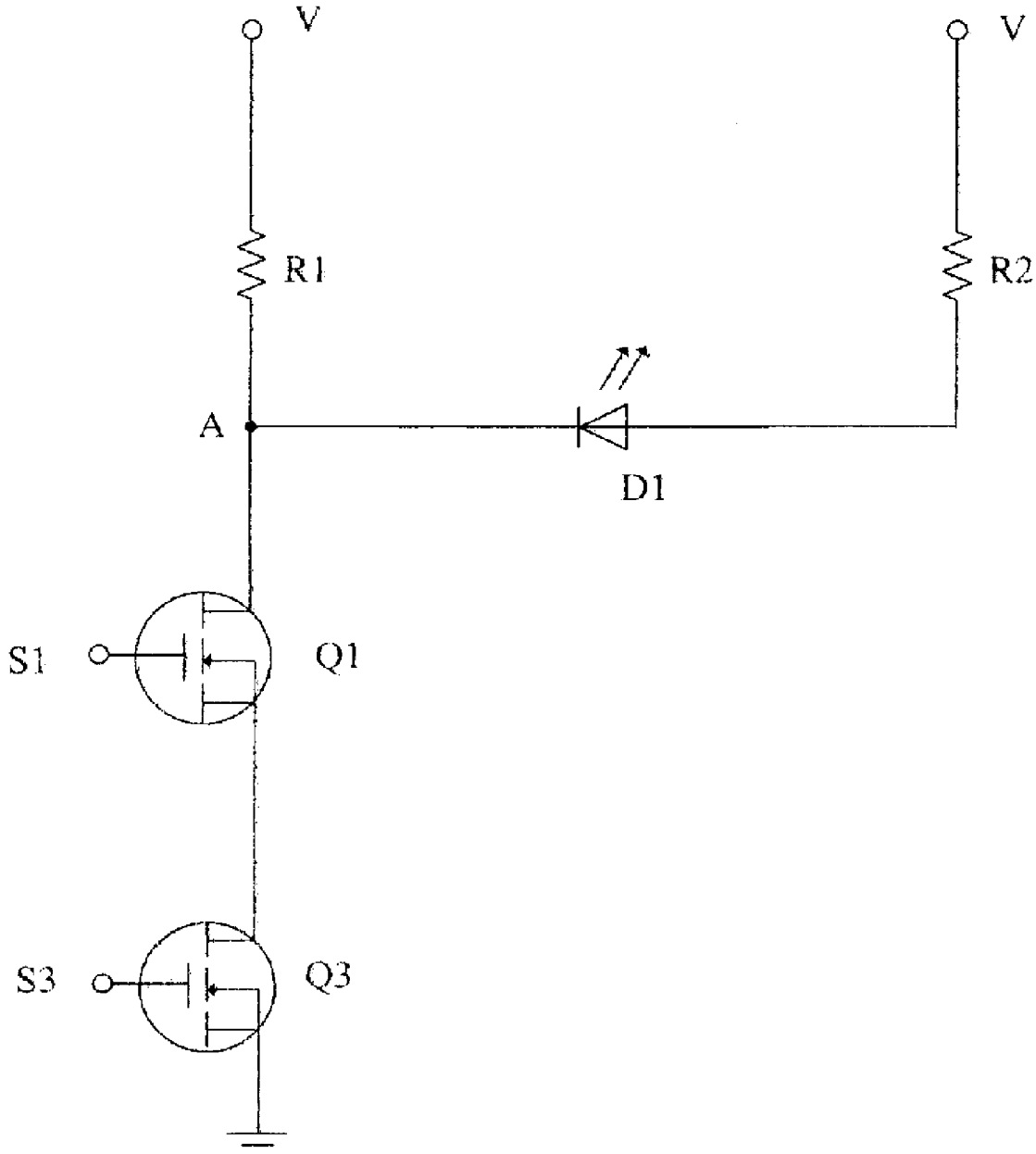
FIG. 2 is a partial circuit diagram of FIG. 1.

Referring to FIG. 2, FIG. 2 depicts part of the circuit of FIG. 1. Different transistors produced by different manufacturers often have different resistances. When the transistors Q1 and Q2 are changed with other transistors that have greater resistances, a voltage of the negative terminal of the first light-emitting diode D1 increases. A voltage difference between the positive terminal and the negative terminal of the first light-emitting diode D1 decreases, so that brightness of the first light-emitting diode D1 reduces.

For keeping the brightness of the light-emitting diode being stable, a resistance of the first resistor R1 should be great enough to lower the voltage of the negative terminal of the first light-emitting diode D1. On the other hand, the electric resistance of the first resistor R1 should not be too great. Because the first resistor R1 is serially connected with the second light-emitting diode D2, and if the resistance of the first resistor R1 is too great, a current passing through the second light-emitting diode D2 is too small to light the second light-emitting diode D2. So the resistance of the first resistor R1 should be selected according to specific characteristics of selected transistors. The second resistor R2 is the same as the first resistor R1.

For example, different 2N7002 transistors which are produced by different manufacturers have different resistances, including 4 ohm, 8 ohm, and 14 ohm. The resistance of the first resistor R1 should be appropriate to perform its function with these transistors.

It is to be understood, even though numerous characteristics and advantages have been set forth in the foregoing description of preferred embodiments, together with details of the structures and functions of the preferred embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A circuit for indicating status of a component of a computer system, comprising:

a first indicator comprising a positive end and a negative end;

a second indicator comprising a positive end connected with the negative end of the first indicator, and a negative end connected with the positive end of the first indicator;

a power supply connected to the positive end of the first indicator via a first resistor, and connected to the positive end of the second indicator via a second resistor;

a first transistor connected between the negative end of the first indicator and a ground; and a second transistor connected between the negative end of the second indicator and the ground;

wherein a drain of the first transistor is connected to a negative end of the first indicator, a source of the first transistor is connected to the ground, a gate of the first transistor is connected to a first control signal, and a drain of the second transistor is connected to the negative end of the second indicator, a source of the second transistor is connected to ground, a gate of the second transistor connected to a second control signal.

2. The circuit as described in claim 1, wherein the first and second indicators are light-emitting diodes.

3. The circuit as described in claim 1, wherein the component is a hard disk driver, the first control signal indicates the hard disk driver is enabled to be operated, and the second control signal indicates the hard disk driver is active.

4. The circuit as described in claim 3, wherein the first control signal is a high level signal, and the second control signal is a square-wave signal.

5. The circuit as described in claim 3, further comprising a third transistor connected between the first transistor and the ground, and a fourth transistor connected between the second transistor and the ground.

6. The circuit as described in claim 5, wherein a drain of the third transistor is connected to the source of the first transistor, a source of the third transistor is connected to the ground, and a gate of the third transistor is connected to a third control signal.

7. The circuit as described in claim 6, wherein the third control signal is a high level signal, and indicates a power source of the hard disk driver is normal.

8. A circuit assembly comprising:

a first switch means serially electrically connectable with a first power source, and responsive to a first control signal, generated due to a first status of an electronic component of a system, to switch electrical connectivity of said first switch means;

a second switch means serially electrically connectable with a second power source, and responsive to a second control signal, generated due to a second status of said component, to switch electrical connectivity of said second switch means;

a first indicator electrically connectable between said first switch means and said second switch means, and feasible to indicate said first status of said component by means of switching of said first switch means to said electrical connectivity thereof according to said first control signal, and by means of powering of said second power source; and a second indicator electrically connectable between said first switch means and said second switch means, and in a parallel connection with said first indicator, said second indicator feasible to indicate said second status of said component by means of switching of said second switch means to said electrical connectivity thereof according to said second control signal, and by means of powering of said first power source.

9. The circuit assembly as described in claim 8, wherein said first and second switch means are transistors, each of said first and second switch means serially electrically connects with a third transistor responsive to a third control signal generated due to a third status of said component.

* * * * *